US007118015B2

(12) United States Patent
Newman

(10) Patent No.: US 7,118,015 B2
(45) Date of Patent: Oct. 10, 2006

(54) THIMBLE

(76) Inventor: Liuxin Newman, 14 Bedford Ave, North Turramurra NSW (AU)

( * ) Notice: Subject to any disclaimer, the term of this patent is extended or adjusted under 35 U.S.C. 154(b) by 190 days.

(21) Appl. No.: 10/689,243

(22) Filed: Oct. 20, 2003

(65) Prior Publication Data

US 2004/0099701 A1 May 27, 2004

(30) Foreign Application Priority Data

Nov. 8, 2002 (AU) ..... 2002952558

(51) Int. Cl.
*D05B 91/04* (2006.01)

(52) U.S. Cl. ..... 223/101

(58) Field of Classification Search ..... 2/16, 2/21, 163; 223/101; 128/878, 880; 602/5, 602/21, 22; 132/73
See application file for complete search history.

(56) References Cited

U.S. PATENT DOCUMENTS 207,708 A * 9/1878 Boyer ..... 294/25
478,356 A * 7/1892 Paige ..... 602/22
490,733 A * 1/1893 Armat ..... 2/21
500,056 A * 6/1893 Dante ..... 602/22
1,417,414 A * 5/1922 Sanders ..... 602/22
2,348,962 A * 5/1944 Davis ..... 227/139
3,228,033 A * 1/1966 Ames et al. ..... 2/21
3,531,029 A * 9/1970 Lee ..... 223/101
3,728,736 A * 4/1973 Pugh ..... 2/21
4,127,222 A * 11/1978 Adams ..... 223/101
4,955,515 A * 9/1990 Brull ..... 223/101
5,450,626 A * 9/1995 Sorrels ..... 2/21
5,609,165 A * 3/1997 Lambert ..... 128/880
5,842,227 A * 12/1998 Rabin et al. ..... 2/21
5,954,245 A * 9/1999 Kluesner ..... 223/101
6,237,148 B1 * 5/2001 Graham ..... 2/21
6,647,549 B1 * 11/2003 McDevitt et al. ..... 2/21

* cited by examiner

*Primary Examiner*—Gary L. Welch
(74) *Attorney, Agent, or Firm*—Cohen, Pontani, Lieberman & Pavane

(57) ABSTRACT

A thimble extending up over the first knuckle position so as to assist the user in maintaining a substantially straight finger at the first knuckle position and having a needle contacting surface with one or more indents between the tip of the finger and a position adjacent or past the first knuckle position.

12 Claims, 1 Drawing Sheet

THIMBLE

BACKGROUND OF THE INVENTION

Field of the Invention

The present invention relates to thimbles and in particular to a thimble which extends along the finger of a user past the first knuckle position so as to assist in maintaining the first two bones of the finger either side of the first knuckle relatively colinear.

For many years thimbles have been used in order to assist needle workers to continually push needles through material without sustaining damage to the front of their fingers occasioned by the needle whilst the finger is applying forced to it. Typically thimbles are frustro-conical in shape, are closed ended and do not extend up to the first knuckle position and certainly not past the first knuckle position. Typically they only cover the tip of the finger in order to facilitate normal movement of the finger and bending and flexing of the finger about the first knuckle position. Typically thimbles are provided with indents in order to retain the tip of a needle and prevent the needle slipping along the surface of the thimble.

Recently different needle working techniques have been advocated and in particular one such technique involves keeping the finger which is being used to push the needle as straight as possible at the first knuckle position. More leverage can be applied if such a method is utilised as well as other advantages although most persons find difficulty controlling movement of their fingers which involves not bending at the first knuckle position nearest the tip of the finger but bending the finger at the second and third knuckle position. It will be appreciated that if the finger is bent at the first knuckle position and a thimble is used to urge a needle for a significant distance the angle between the thimble and the needle will change substantially and eventually when this angle becomes too far removed from 90 degrees the needle will slip out of any indent in the thimble along the face of thimble thereby preventing further pushing of the needle by the finger and possibly occasioning injury to the needle worker.

SUMMARY OF THE INVENTION

It is accordingly an object of the present invention to circumvent one or more of the above-mentioned deficiencies of existing thimbles or at least to provide the market with an alternative.

According to the present invention there is provided a substantially rigid thimble adapted to extend up over the first knuckle position so as to assist the user in maintaining a substantially straight finger at the first knuckle position and having a needle contacting surface with one or more indents between the tip of the finger and a position adjacent or past the first knuckle position.

According to another aspect of the present invention there is disclosed a method of quilting utilising a thimble as a brace in order to ensure that the first knuckle position of the thimble bearing finger used to push the needle is not bent more than 25 degrees.

According to another aspect of the present invention there is disclosed a method of quilting utilising a thimble as a brace in order to ensure that the first knuckle position of the thimble bearing finger used to push the needle is not bent thereby facilitating use of long needles with multiple stitches loaded thereon.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

One embodiment of the present invention will now be described with reference to the accompanying drawings in which.

DETAILED DESCRIPTION OF THE PRESENTLY PREFERRED EMBODIMENTS

Figure 1:
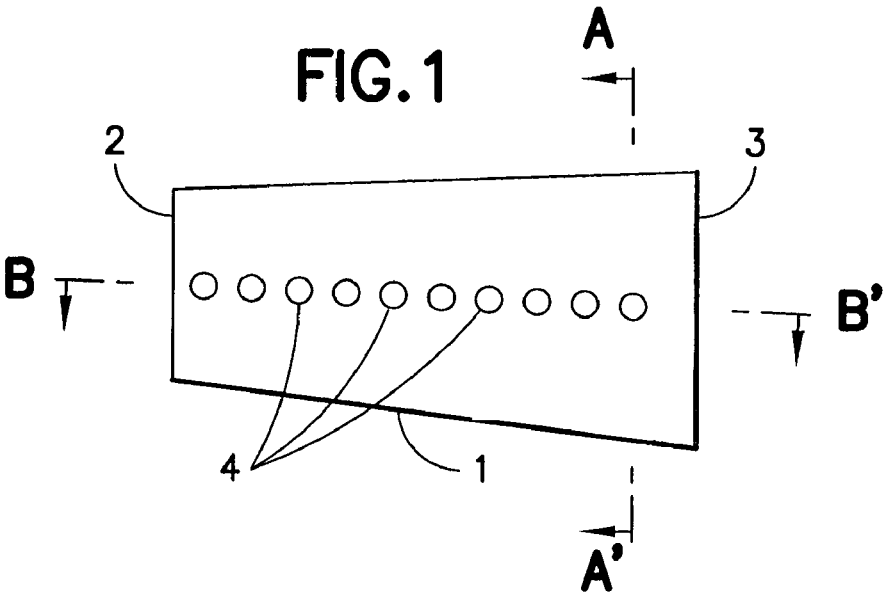
FIG. 1 is a side elevation of a thimble in accordance with the present invention.
Figure 2:
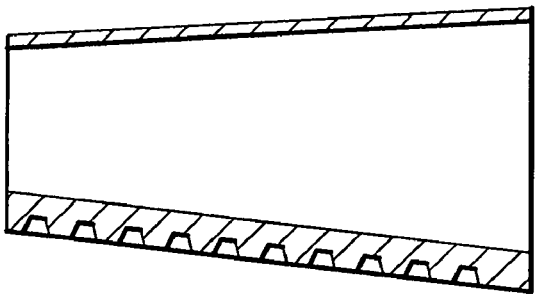
FIG. 2 is a longitudinal section through B–B' of the thimble of FIG. 1.

According to the embodiment of FIG. 1 there is disclosed a frustro-conical shaped thimble 1 being open ended at its tip 2 as well as being open ended in the traditional manner at the opposite end 3 to facilitate insertion of a finger therein.

The thimble may be constructed of any suitable material such as stainless-steel. The body of the thimble is rigid as is traditional in relation to thimbles. Multiple indents 4 are provided in the front face 6 of the thimble in order to provide a variety of positions at which the blunt end of a needle may be retained and thereby controlled by the needleworker via the thimble. It should be appreciated that the number shape and orientation of the indents 4 may be varied in accordance with normal practice and need not necessarily occur in a straight line as depicted in the depicted embodiment.

As the thimble of the present invention is designed to be longer than a normal thimble and extend past the first knuckle position there is a greater range of longitudinal positions at which a needle may be engaged by the thimble. This is advantageous as it can be used to vary the effort required to push the needle. For example when a needle is being pushed through thick material or a number of thicknesses of material or in situations where the needle is large or somewhat blunt it will be desirable to engage the needle on the thimble at a position further from the fingertip so that more mechanical advantage may be applied. Conversely if a person has a powerful finger or if the material is thin and the needle sharp then an indent nearer the tip of the thimble may be utilised.

An additional advantage of the straight first knuckle position ensured by a thimble in accordance with the present invention is the that use of a longer needle is facilitated and such a longer needle may carry more stitches thereby enabling the worker to have greater productivity.

Figure 3:
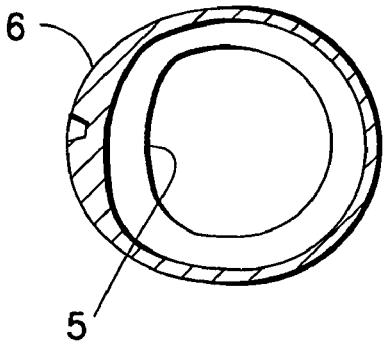
FIG. 3 is a transverse cross section through A–A' of the thimble of FIG. 1.

With reference to FIG. 3 it will be observed that the inside 5 of the front face 6 of the thimble is flattened in order to assist in keying the thimble to the finger thereby preventing rotation of the thimble about the finger with consequential loss of control of the needle due to the needle jumping out of one of indents 4. The inside of the rear face may also be flattened to assist this purpose. As also shown in FIG. 3 which, as described above, is a transverse cross section through A–A' of the thimble of FIG. 1, the thimble wall extends about the full circumference at line A–A'.

Is not essential that a thimble in accordance with the present invention be open-ended as depicted at 2 in FIG. 1 although it has been found that if the thimble is open ended then a lesser number of sizes of thimble need to be produced in order to accommodate a wide range of finger sizes. The frustro-conical shape of the thimble in conjunction with the open-ended design gives rise to this advantage in sizing such that one thimble will fit a fairly large variety of sizes of finger. It will be appreciated that sizing may otherwise be more difficult to achieve with a long thimble which is intended to cover the first knuckle position as compared with a traditional thimble which does not extend about the first knuckle position.

It is envisaged that for an average hand an open ended thimble in accordance with the present invention may be in the vicinity of 20–45 mm in length as opposed to say 15 to 25 mm for a conventional thimble.

It will be appreciated that alternate embodiments of the present invention may be devised without departing from the scope and intendant thereof.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A thimble adapted to extend over the first knuckle position of a single one of a user's fingers, about the finger's full circumference, said thimble comprising a rigid material to prevent bending of the user's finger at the first knuckle position, the thimble having a needle contacting surface with one or more indents between the tip of the finger and a position adjacent or past the first knuckle position, said needle contacting surface indents being configured to secure a tip of a needle disposed in one of said indents.

2. A thimble in accordance with claim 1 hereof being open at both ends so that the tip of the finger is not covered.

3. A thimble in accordance with claim 1 hereof having a multiplicity of indents in the needle contacting surface; the indents extending between a position adjacent the tip of the finger and a position adjacent the first knuckle.

4. A thimble in accordance with claim 1 hereof being open-ended and between 20 and 45 mm in length.

5. A thimble in accordance with claim 1 hereof being open-ended and between 25 and 45 mm in length.

6. A thimble in accordance with claim 1 hereof wherein the inside of the front face of thimble substantially flattened in order to assist in keying the thimble to the finger thereby preventing rotation thereabout.

7. A thimble in accordance with claim 1 hereof wherein one or more of the inside faces of the thimble are substantially flattened in order to assist in keying the thimble to the finger thereby preventing rotation thereabout.

8. A thimble in accordance with claim 1 hereof which tapers inwardly along its length as it extends towards the finger tip.

9. A method of quilting utilising a thimble in accordance with claim 1 hereof as a brace in order to ensure that the first knuckle position of the thimble bearing finger used to push the needle is not bent more than 25 degrees.

10. A method of quilting utilising a thimble in accordance with claim 1 hereof as a brace in order to ensure that the first knuckle position of the thimble bearing finger used to push the needle is not bent more than 15 degrees.

11. A method of quilting utilising a thimble in accordance with claim 1 hereof to facilitate use of long needles with multiple stitches loaded thereon.

12. A thimble adapted to extend over the first knuckle position of a user of a single one of a user's fingers, about the finger's full circumference, so as to form a close tolerance push fit over the first knuckle, the thimble comprising a rigid material to prevent bending of the user's finger thereby bracing the knuckle against substantial bending; the thimble having a needle contacting surface with one or more indents between the tip of the finger and a position adjacent or past the first knuckle position, said needle contacting surface indents being configured to secure a tip of a needle disposed in one of said indents.

* * * * *